United States Patent [19]

Dick

[11] 4,265,325

[45] May 5, 1981

[54] PERCUSSION ROCK BIT

[75] Inventor: David C. Dick, Islington, Canada

[73] Assignee: Canadian General Electric Company Limited, Toronto, Canada

[21] Appl. No.: 80,664

[22] Filed: Oct. 1, 1979

Related U.S. Application Data

[63] Continuation of Ser. No. 905,863, May 15, 1978, abandoned.

[30] Foreign Application Priority Data

Jun. 10, 1977 [CA] Canada ..... 280272

[51] Int. Cl.[3] ..... E21B 10/52; E21B 10/62

[52] U.S. Cl. ..... 175/410; 407/34; 407/102; 175/419

[58] Field of Search ..... 175/374, 409, 410, 419, 175/420; 407/33, 34, 40, 41, 61, 66, 102, 110; 76/108 R, 108 A

[56] References Cited

U.S. PATENT DOCUMENTS

| | | | |
|---|---|---|---|
| 2,025,308 | 12/1935 | Redinger | 407/34 |
| 2,309,410 | 1/1943 | Miller | 407/33 |
| 2,502,128 | 3/1950 | Curtis | 175/419 X |
| 2,614,812 | 10/1952 | Shepherd | 175/413 X |
| 2,614,813 | 10/1952 | Shepherd | 175/410 |
| 3,563,325 | 2/1971 | Miller | 175/420 X |

FOREIGN PATENT DOCUMENTS

| | | | |
|---|---|---|---|
| 520088 | 4/1940 | United Kingdom | 175/409 |
| 643790 | 9/1950 | United Kingdom | 175/410 |
| 858513 | 1/1961 | United Kingdom | 175/410 |
| 468994 | 7/1975 | U.S.S.R. | 175/409 |

*Primary Examiner*—James A. Leppink
*Assistant Examiner*—Richard E. Favreau
*Attorney, Agent, or Firm*—Raymond A. Eckersley

[57] ABSTRACT

In a percussive rock bit or similar tool wherein cemented carbide cutting inserts are retained in open radial slots in the head of the tool, an improved method of mechanically retaining the inserts. The inserts are provided with a plurality of elongated radially aligned serrulations along each flank thereof, the thickness of the insert as measured between the crests of opposing serrulations being such as to provide a substantial interference with the slot wall. The inserts may be cold fitted by sliding along the slot, following which body material is peened so as to overlay a small chamfer at the base of the outwardly facing wall of the inserts. The inwardly facing walls of the inserts may be inclined so as to retain the center plug of the rock bit mechanically.

15 Claims, 5 Drawing Figures

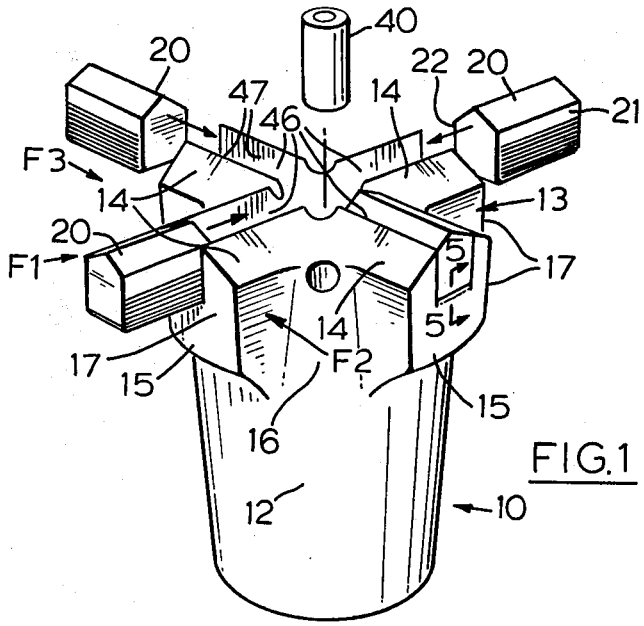
FIG. 1
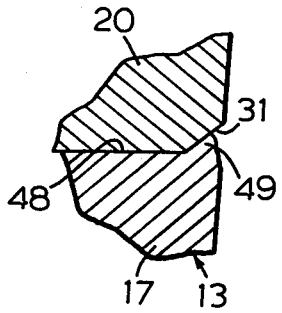
FIG. 5
FIG. 2
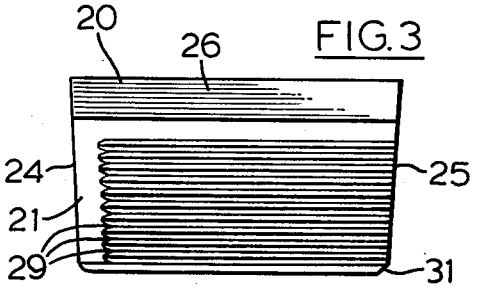
FIG. 3
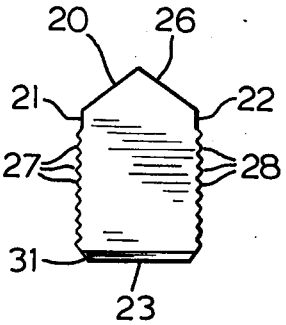
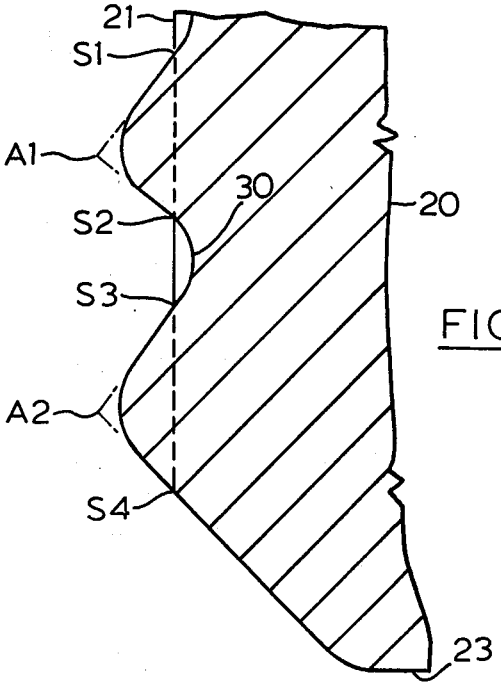
FIG. 4

PERCUSSION ROCK BIT

This is a continuation, of application Ser. No. 905,863, filed May 15, 1978, abandoned.

This invention relates to cutting tools, particularly percussive rock bits; it still more particularly relates to an novel construction wherein hard cutting inserts are retained in the body of the rock bit, and to novel inserts employed therewith.

The percussive rock bits to which my invention relates generally comprise a high strength steel body having a head portion with a plurality of radial slots formed therein, each slot being open to both the cutting face of the head and the side wall thereof. Within each slot is located a relatively massive insert of a hard, cemented carbide material. The percussive rock bits of present day commerce are all believed to employ a brazed joint between the carbide insert and the slots cut in the tool body. The deficiencies of these brazed rock bits have long been known. Primarily, the thermal stresses that ensue from the brazing process place a constraint upon the types of cemented carbide that may be employed, these usually being limited to grades of lower hardness. Fracture failure of the carbide inserts due to brazing induced stress is commonly experienced, particularly when hard rock formations are encountered. Failure of the brazed joint may be experienced due to differential expansion between the steel body of the rock bit and the carbide insert.

Numerous proposals have been made in the prior art directed to the mechanical retention of carbide cutting inserts in the radial slots of the tool body. In spite of the substantial advantages that are to be afforded therefrom, it is not believed that any percussive rock bits of this type have achieved commercial fruition. The methods advocated in the prior art for the mechanical retention of inserts usually involve forming a dovetail shaped slot in the steel body of the rock bit. In U.S. Pat. No. 2,575,438, Nov. 20, 1951 to Alexander et al, the hard cutting insert has a width less than that of the dovetail slot, and a wedge is driven between the insert and the slot wall to retain the insert in place. In U.S. Pat. No. 3,563,325, Feb. 16, 1971 to Miller, the insert has a complementary shape to the dovetail slot and is retained therein by an interference fit.

Mechanical retention of carbide inserts is well known in configurations of rock cutting tools other than the radially slotted type under consideration. In such other types, the cutting face of the tool is provided with axial bores into which button inserts are interference fitted. These button inserts are almost completely embedded in the relatively massive body of the cutting tool. By contrast, the general design requirements of the radially slotted rock bits under consideration do not permit the radial slots to be heavily buttressed. Deep axial grooves are usually formed in the sidewall of the tool on each side of radial slot so as to permit the removal of rock particles from the vicinity of the tool head, and also to expose a sharp cutting edge of the insert. It appears that where an interference fit is attempted in a dovetail slot configuration, the jaws of the slot tend to undergo deformation adjacent the base of the slot to vary the dovetail angle whereby a good fit between the insert and the slot is no longer possible.

I have found that in percussive rock bits, the carbide inserts may be mechanically retained in the radial slots if the flanks of the insert in interference contact with the sides of the slot are formed with a plurality of radially extending serrulations. Extensive field trials have shown percussive rock bits constructed in accordance with my invention to have a high degree of reliability. Surprisingly they may be used and resharpened until the depth of the slot into which the insert is received is scarcely if at all greater than that at which the best brazed joints would be expected to fail.

In its broadest aspect, as directed to a cutting tool combination, my invention comprises a steel tool body having a head portion including a face wall and a side wall intersecting the face wall, an elongated slot in the head communicating with the face wall and the side wall. The cemented carbide cutting insert has a base and opposed flank walls upstanding therefrom, the base and the flank walls together in right cross section being of complementary form to the right cross section of the slot. Each flank wall is provided with a plurality of elongated surrulations generally parallel to the base of the insert, the width of the insert as measured between the crests of opposed serrulations being greater than the width of the slot prior to the insertion of the insert therein to provide an interference fit therewith, the crests being rounded to minimize shaving of the slot walls thereby when the insert is being positioned in the slot.

The precise shape of the slot cross section and the complementary insert cross section is not of importance. My invention does not in any manner depend upon a dovetail fit between the insert and the slot walls. Desirably the walls of the slot will be perpendicular to the base thereof and of uniform width, as is general in brazed tool construction. The flanks of the insert will be generally parallel (ignoring the serrulations). My invention thus lends itself to standard norms of manufacture in contrast to dovetail fitted inserts wherein very close tolerances would be required.

In a more specific aspect, my invention comprises a percussive rock bit comprising a steel body having a head portion including a face wall and side wall intersecting the face wall, the side wall having a plurality of deep axial grooves therein thereby forming a plurality of radial arms, each of the arms having a slot opening therein, each slot communicating with both the face wall and the side wall. A cemented carbide cutting insert is positioned in each said slot, the inserts being defined by walls including a base wall and flank walls upstanding therefrom, the inserts having a right cross section of complementary form to that of the slot. Specifically the improvement comprises providing each said flank wall with a plurality of elongated radial serrulations, the width of said insert, as measured between the crests of opposed serrulations being greater than the width of the slot prior to the insertion of the insert therein, to provide an interference fit therewith.

In a still further and preferred aspect, my invention comprises a cemented carbide insert for a cutting tool, the insert being defined by walls including a generally planar base wall, a pair of generally planar opposed flank walls upstanding from the base wall, the flank walls being provided with a plurality of elongated serrulations aligned with the base wall.

Desirably the flank walls of the insert will be perpendicular to the base wall. Still more desirably, the serrulations will be of a form to be explained in some detail in connection with the preferred, illustrated embodiment of my invention.

Whilst I do not wish to be bound by theory regarding the successful operation of percussive rock bits constructed according to my invention, it is to be remarked that my structure permits very high interference fits between the insert and the slot in which it is retained. Thus the crest of each serrulation may have an interference of about 0.4 mm (18 mils) with the side of the slot i.e. a total interference of about 0.9 mm. Localized elastic and plastic deformation of the slot wall is observable in the region adjacent the crest of each serrulation. Whilst there is some tendency of the jaws of the slot to spread open, this is easily contained in the assembly process as will be further described. In fact, it is found that the pressures developed on the inserts may be sufficiently high to have resulted in compressive failure of the insert at the crests of lower serrulations, and special relief profiles may sometimes be necessitated as also will be described.

Other aspects, objects and advantages of my invention will be more apparent from a consideration of the accompanying detailed description of a preferred embodiment thereof, as illustrated in the drawings wherein:

FIG. 1 shows a percussive drill bit in accordance with my invention in a perspective partially exploded view;

FIG. 2 shows in end elevation a cutting insert for use in the drill bit of FIG. 1;

FIG. 3 shows in side elevation the cutting insert of FIG. 2;

FIG. 4 shows detail of the serrulations of the cutting insert of FIG. 2 in the region of the base thereof;

FIG. 5 is a view along section line 5–5 of FIG. 1.

Referring now to the figures, a percussive rock bit generally denoted by the numeral 10 comprises a high strength steel body 12 including a head portion 13 having a face wall 14 and a skirt 15 intersecting the face wall. Side 15 is provided with a plurality of deep axial grooves 16 so as to form a plurality of radially extending arms 17 between each pair of grooves. Within each arm is provided a radial slot 46, each slot being in communication with face wall 14 and skirt 15 of head 13. Each slot 46 is defined by a seat surface 48 and opposed cheek walls 47 upstanding therefrom. Cheek walls 47 are contained in planes parallel to the axis of rotation of rock bit 10, and the seat surface 48 is perpendicular to the cheeks.

Rock bit 10 further comprises a rock cutting insert 20 held in each radial slot 46. Inserts 20 are manufactured from a cemented carbide, preferably tungsten carbide, having a hardness generally at least as high as about 82, preferably having a hardness in the range of 89–91 or higher on the Rockwell A scale. Insert 20 is defined by opposed flank walls 21, 22 and bottom wall 23, the right cross section of this portion of the insert being of generally complementary shape to that of radial slot 46 into which the insert is received. Bottom wall 23 of insert 20 will usually be rectangular. The insert 20 is further defined by inwardly facing end wall 24, outwardly facing end wall 25 and a gabled cutting wall 26. Along each flank 21, 22 are formed a plurality of radially extending serrulations 27, 28 respectively. The width of insert 20, taken from the crest of one serrulation 27 to that of an opposed serrulation 28, is such as to provide an interference of about 0.3 mm on each flank with the corresponding cheeks 47 of slot 46 i.e. total interference of about 0.6 mm. This value is not critical, and will depend to some extent upon the size of rock bit 10. In practice total interferences in the range of about 0.2 to 0.9 mm have been found to be satisfactory.

Inserts 20 are inserted radially into slots 46; thus a force indicated in FIG. 1 as F1 may be applied at gable 26 adjacent outwardly facing end 25 so as to simultaneously force base 23 of insert 20 into mating contact with the seat 48 of slot 46, and to slide the insert into slot 46. The cheeks 47 of slot 46 tend to spread outwardly under the strong pressures involved. However they are buttressed during the inserting process by applying opposed containing forces shown in FIG. 1 as F2 and F3. It is found to be desirable to provide a small lead on the serrulations, this being denoted in FIG. 3 by the numeral 29, so as to reduce the tendency of the insert 20 to shave the cheeks 47 of slot 46 rather than compress them. Some shaving of the seat 48 of slot 46 is desirable to assist in providing a good bed for the insert.

In the particular form of the rock bit 10 illustrated, a hollow centre plug 40 is employed through which coolant flows during the rock drilling operation. In rock bits of the prior art wherein the inserts are retained by brazing, the centre plug 40 would normally be secured by brazing simultaneously to the securing of the inserts. However, in the presently advocated method of securing the inserts a separate brazing operation would be necessary; this is undesirable both in terms of cost and also as it may lead to an undesirable softening of the steel body 12 of rock bit 10. My invention contemplates a novel method for the mechanical retention of centre plug 40. Thus, as best seen in FIG. 3, the inwardly facing end 24 of each insert 20 is upwardly raked at a small angle to the vertical, generally in the range of about 0.5° to 3° more preferably in the range 0.5° to 1°. In assembling rock bit 10, centre plug 40 is placed generally in position and the inserts 20 pressed into slots 46, the axially inward ends thereof which are in communication, so as to slightly compress the centre plug 40 between the inwardly facing ends of the inserts, thereby wedging the centre plug in position. Other means is equally contemplated for the mechanical rentention of centre plug 40. In particular it is contemplated that the inwardly facing end 24 of each insert 20 be provided with a small projection adjacent the bottom wall 23 to engage centre plug 40.

In use, the inserts 20 of rock bit 10 are subject to a moderately strong force tending to slide the inserts outwardly from the respective slots 46. The inserts may be keyed into place, for example as contemplated in the aforesaid U.S. Pat. No. 2,575,438. A preferred method of retaining the inserts 20 comprises providing each insert with a chamfered edge 31 at the intersection of base 31 and the outwardly facing side wall 25 of the insert. Subsequent to the insert being pressed into position in slot 46, the body 12 of rock bit 10 is peened so as to form an overlay 49 on chamfer 31. Normal practise is to upwardly rake outwardly facing side 25 of insert 20, as seen in FIG. 3, so as to provide a clearance for the side 15 of cutting tool 10, thus ensuring that the metal 49 overlaying chamfer 31 is not abraded.

Whilst the precise form of the serrulations 27, 28 is not believed to be critical, a preferred form thereof is illustrated in FIG. 4, and is typified therein by the upper of the two profiles shown. In general the serrulations approximate a triangular shape S1, S2, A1 wherein the line segment S1, S2, lays in the general plane of flank wall 21 or 22 of insert 20. The crest angle S1 A1 S2 is preferably about 90°; it is found that as the crest angle increases the tendency of the serrulations to compressive failure is decreased. Desirably the crest is rounded in the manner illustrated so as to still further increase the resistance to compressive failure. Such rounding further serves to reduce shaving of the walls 47 of grooves 46 during the insertion of inserts 20 therein.

Serrulations 27, 28 are desirably asymmetric in profile, with upper surface A1 S1 being of greater length than that of lower surface A1 S2. Angle S1 S2 A1 is greater than it would be in the case where the upper and lower surfaces of the serrulations are identical. By increasing this angle, the outward thrust reactant to which walls 47 of slot 46 are subjected upon each percussive impact experienced by rock bit 10 is reduced, and the inserts may be strongly retained in slots 46 for the useful cutting life of the inserts. This asymmetry may be otherwise expressed as the crest of a serrulation locating generally below the midpoint of the root thereof. It appears that serrulations 27, 28 act to delocalize vertical thrust forces transmitted between the head 13 of rock bit 10 and the inserts 20. In the prior art rock bits of brazed construction, these thrust forces are transmitted almost exclusively between the base of the insert and the seat of the slot in which it is brazed. After considerable use it is often found that the slot seat is compacted, and the brazed joint is quickly subjected to shear failure. This tendency is counteracted by heat treating the head of the rock bit to a higher hardness than that desirable for the remainder of the body, thus necessitating an additional process step. I find that in rock bits 10 constructed in accordance with my invention the inserts 20 are strongly retained throughout their useful cutting life even though the head 13 of the rock bit not be heat treated to this higher hardness, and such additional step seems neither necessary nor desirable.

In trials it has been found that compressive failure of the inserts is most likely to occur at the serrulation adjacent the base of insert 20. Stress may be relieved by locating the lowest serrulation not less than about one tooth pitch above base 23. It is further found to be advantageous to increase the crest angle of the lowest tooth, shown as S3 A2 S4 in FIG. 4, to about 100°.

It is preferred that the width of insert 20 when taken between the trough 30 of a one serrulation 27 and that of an opposing serrulation 28 be marginally less than the width of the insert, as measured between opposed, planar portions of flank walls 21, 22. A preferred value for this differential is about 0.1 mm. As the width of slot opening 46 is normally identical to the width of the insert 20 measured between the planar portions of the flank walls thereof, the width of the insert between the troughs of opposing serrulations 27, 28 will also be marginally less than the width of slot opening 46. When an insert 20 is secured in slot 46 it is found that there may be a small elastic displacement of wall 47 into trough 30. Additionally, under the influence of differential expansion, there may be appreciable elastic displacement into the trough thereby relieving pressure on insert 20.

As previously stated, part of the difficulty associated with the use of dovetail mounted inserts resides in the extremely close manufacturing tolerances that must be maintained both in the construction of the slots into which the inserts are received and in the inserts themselves. The structure of the present combination in the preferred form thereof does not relay upon the provision of close tolerances, and indeed for may purposes the inserts may be employed in the as sintered stage, or with a minimum amount of dressing so as to generally round off the crests of the serrulations 27, 28 and to adjust the width of the insert, when measured between the opposing crests of the serrulations, within relatively wide tolerance limits.

Whilst my invention has been particularly described with reference to a preferred embodiment thereof, it is not to be restricted to that precise form. Rather the scope of the invention is to be considered from the scope and spirit of the embodiments of the claims appended hereto.

What I claim as new and desire to secure by Letters Patent of the United States is:

1. A cutting tool comprising in combination a steel body having a head portion including a face wall and a side wall intersecting said face wall, an elongated slot in said head communicating with said face wall and said side wall;

a cemented carbide cutting insert positioned in said slot and having a base and opposed flank walls upstanding therefrom, said base and said flank walls together in right cross section being of complementary form to the right cross section of said slot, each said flank wall being provided with a plurality of elongated serrulations extending substantially parallel to the base of said insert, the width of said insert as measured between the crests of opposed serrulations being greater than the width of said slot prior to the insertion of said insert therein to provide an interference fit therewith, and the width of said insert, as measured between the troughs of opposed serrulations, is marginally less than the width of said slot, to provide relief clearance at said troughs.

2. A cutting tool according to claim 1, wherein said slot is right angular in cross section, and of substantially uniform width from end to end thereof.

3. A cutting tool according to claim 1, wherein said insert includes an outwardly facing wall upstanding from said base having a chamfered portion at the intersection of the wall and the base, and wherein said chamfered portion is overlayed with metal integral with said body whereby said insert is keyed against outward longitudinal movement in said slot.

4. A cutting tool according to claim 1, wherein said serrulations have rounded crests.

5. A rock bit comprising a steel body having a head portion including a face wall and side wall intersecting said face wall, said side wall having a plurality of deep axial grooves therein thereby forming a plurality of radial arms, each said arm having a slot opening therein, each said slot communicating with said face wall and said side wall, and a cemented carbide cutting insert in each said slot, each said insert being defined by walls including a base wall and flank walls upstanding therefrom, said insert having a right cross section of complementary form to that of said slot, each said flank wall being provided with a plurality of elongated radial serrulations, the width of said insert, as measured between the crests of opposed serrulations being greater than the width of said slot prior to the insertion of said insert therein, to provide an interference fit therewith, and the crests of a serrulation locates generally below the mid point of the root thereof.

6. A rock bit according to claim 5, wherein said slot is right angular in cross section.

7. A rock bit according to claim 5, wherein the width of said insert, as measured between the troughs of opposed serrulations is marginally less than the width of said slot.

8. A rock bit according to claim 5, wherein said serrulations have rounded crests.

9. A rock bit according to claim 5, wherein said insert has an outwardly facing end wall, and wherein said insert is provided with a chamfered portion where said end wall intersects said base wall, said chamber being overlayed with body metal to key said insert against outward radial movement in said slot.

10. A rock bit according to claim 9, wherein the end of each said slot adjacent the axis of rotation of said rock bit is open, and wherein each said insert is defined by an inwardly facing endwall, said endwalls together cooperating to retain a central orifice plug solely by mechanical means.

11. A rock bit according to claim 10, wherein said endwalls are outwardly and upwardly formed at an angle of 0.5° to 1°.

12. A cemented carbide insert for a cutting tool, said insert being defined by walls including a substantially planar base wall, a pair of substantially planar opposed flank walls upstanding from said base wall, said flank walls being provided with a plurality of elongated serrulations extending substantially parallel with said base wall, the crests thereof being rounded, said serrulations being provided with a lead to facilitate insertion.

13. A cemented carbide insert for a cutting tool, said insert being defined by walls including a substantially planar base wall, a pair of substantially planar opposed flank walls upstanding from said base wall, said flank walls being provided with a plurality of elongated serrulations extending substantially parallel with said base wall, the crests thereof being rounded, the crest of a serrulation being located generally below the mid point of a root thereof.

14. A cemented carbide insert for a cutting tool, said insert being defined by walls including a substantially planar base wall, a pair of substantially planar opposed flank walls upstanding from said base wall, said flank walls being provided with a plurality of elongated serrulations extending substantially parallel with said base wall, the width of said insert, as measured between troughs of opposing serrulations, being marginally less than the width of said insert as measured between opposing planar portions of said flank walls.

15. A cemented carbide insert for a cutting tool, said insert being defined by walls including a substantially planar base wall, a pair of substantially planar opposed flank walls upstanding from said base wall, said flank walls being provided with a plurality of elongated serrulations extending substantially parallel with said base wall, the crests thereof being rounded, each said flank wall including a planar portion interposed between said serrulations and the inwardly facing endwall of said insert.

* * * * *